US009681221B2

(12) United States Patent
Tchang et al.

(10) Patent No.: US 9,681,221 B2
(45) Date of Patent: Jun. 13, 2017

(54) DELEGATE UNIT AND CONFERENCE SYSTEM WITH THE DELEGATE UNIT

(71) Applicant: Robert Bosch GmbH, Stuttgart (DE)

(72) Inventors: Chen Tchang, Bavel (NL); Kees Nuijten, Bergen op Zoom (NL); Aldo Van Dijk, Tilburg (NL); Hatem Elayeb, Eindhoven (NL); Martien Kas, Sint Willebrord (NL)

(73) Assignee: ROBERT BOSCH GMBH, Stuttgart (DE)

( * ) Notice: Subject to any disclaimer, the term of this patent is extended or adjusted under 35 U.S.C. 154(b) by 16 days.

(21) Appl. No.: 14/776,959

(22) PCT Filed: Mar. 15, 2013

(86) PCT No.: PCT/EP2013/055408
§ 371 (c)(1),
(2) Date: Sep. 15, 2015

(87) PCT Pub. No.: WO2014/139586
PCT Pub. Date: Sep. 18, 2014

(65) Prior Publication Data

US 2016/0044407 A1 Feb. 11, 2016

(51) Int. Cl.
*H04R 9/08* (2006.01)
*H04R 1/32* (2006.01)
(Continued)

(52) U.S. Cl.
CPC ..... *H04R 1/326* (2013.01); *H04R 1/021* (2013.01); *H04R 27/00* (2013.01); *H04R 2227/005* (2013.01)

(58) Field of Classification Search
CPC ..... H04R 1/021; H04R 1/326; H04R 27/00; H04R 2227/005
(Continued)

(56) References Cited

U.S. PATENT DOCUMENTS 8,509,703 B2 * 8/2013 Chen ..... H04M 1/03 455/67.13
2003/0059061 A1 * 3/2003 Tsuji ..... H04M 3/569 381/92
(Continued)

FOREIGN PATENT DOCUMENTS

EP 1686835 8/2006
GB 2128054 4/1984
(Continued)

OTHER PUBLICATIONS

International Search Report or Application No. PCT/EP2013/055408 dated Mar. 27, 2014 (5 pages).
(Continued)

*Primary Examiner* — Brian Ensey
(74) *Attorney, Agent, or Firm* — Michael Best & Friedrich LLP

(57) ABSTRACT

Conference Systems are commonly used in meeting rooms or plenary halls to support the discussion of a plurality of participants. Such Conference Systems may comprise more than 50 or 100 microphone equipped delegate units, whereby each delegate unit can be assigned to a participant of the discussion. A delegate unit 1 for a Conference System is proposed, the delegate unit comprises a base body 2, a microphone stem body 3 comprising a microphone head 10 and a stem 11, whereby the microphone head 10 is arranged on the stem 11 and whereby the microphone stem body 3 is arranged on the base body 2, whereby the microphone head 10 has a directional microphone characteristic.

21 Claims, 5 Drawing Sheets

(51) Int. Cl.
*H04R 27/00* (2006.01)
*H04R 1/02* (2006.01)

(58) Field of Classification Search
USPC ..... 381/313, 356, 358
See application file for complete search history.

(56) References Cited

U.S. PATENT DOCUMENTS

| | | | | |
|---|---|---|---|---|
| 2005/0105740 | A1* | 5/2005 | Dyer | B60R 11/0241 381/16 |
| 2007/0149246 | A1 | 6/2007 | Bodley et al. | |
| 2007/0263845 | A1* | 11/2007 | Hodges | H04R 1/345 381/150 |
| 2009/0002476 | A1* | 1/2009 | Cutler | H04N 7/142 381/122 |
| 2011/0286609 | A1* | 11/2011 | Faller | H04R 3/005 381/92 |

FOREIGN PATENT DOCUMENTS

| | | | |
|---|---|---|---|
| JP | 10126876 | | 5/1998 |
| JP | 2003087890 | A | 3/2003 |
| JP | 2010532137 | A | 9/2010 |
| WO | 0239783 | | 5/2002 |

OTHER PUBLICATIONS

Written Opinion for Application No. PCT/EP2013/055408 dated Sep. 15, 2015 (7 pages).

* cited by examiner

DELEGATE UNIT AND CONFERENCE SYSTEM WITH THE DELEGATE UNIT

BACKGROUND OF THE INVENTION

The invention relates to a delegate unit for a conference system. More specifically the invention relates to a delegate unit and to a conference system with the delegate unit or a plurality of said delegate units.

Conference systems are commonly used in meeting rooms or plenary halls to support the discussion of a plurality of participants. Such conference systems may comprise more than 50 or 100 microphone equipped delegate units, whereby each delegate unit can be assigned to a participant of the discussion.

During operation, a speech signal of a speaking participant is received by the microphone of the delegate unit, processed and amplified by a central unit and rendered by loudspeakers or headphones to the other discussion participants.

For example, the document EP 1686835 A1 discloses a conference system with a plurality of delegate units. Such a known delegate unit comprises a microphone with an adjustable stem, which is connected to a socket of a housing of the delegate unit.

SUMMARY OF THE INVENTION

According to the invention a delegate unit is proposed, which is adapted for a conference system and especially adapted for a conference system. The delegate unit is placed preferably in front of a person, especially a participant of a discussion.

The delegate unit comprises a base body, especially realized as a housing. The base body may be integrated in a table or in working place. But preferably the base body is placed on a support area and/or support plane, for example on the table or on the working place, which define the support area or support plane.

Furthermore the delegate unit comprises a microphone stem body, whereby the microphone stem body is arranged on the base body. Especially the microphone stem body is supported and/or mechanically coupled to the base body. The base body and the microphone stem body together form the delegate unit.

The microphone stem body comprises a microphone head for receiving a speech signal from the participant and a stem.

According to the invention it is proposed, that the microphone head has a directional microphone characteristic. More specifically, the microphone head does not have an omnidirectional microphone characteristic, whereby omnidirectional direction means that the sensitivity for receiving the speech signal is independent from the receiving angle. Instead, the microphone head is operable to be more sensitive in a main acoustical direction and to be less sensitive in other directions.

It is preferred that the microphone head has a distance factor—abbreviated as DSF—higher than 1.7, especially higher than 1,8 or higher than 1,9. Known DSF are 1.0 for an omnidirectional microphone characteristic and 1,7 for a cardioid, 1,9 for a supercardioid and 2.0 for a hypercardioid microphone characteristic. A DSF factor between 1.7 and 2.0 is preferred, so that the microphone head is between a cardioid and a hypercardioid characteristic, The definition of the distance factor (DSF) is preferably as follows: The basis for the distance factor (DSF) is the random energy efficiency (REE) as the known figure of merit for the overall pickup selectivity of microphones. The random energy efficiency (REE) is defined as:

$$REE = \frac{1}{4\pi}\int_0^{4\pi} f^2(\theta)\, d\Omega_\theta,$$

where $f(\theta)$ is the ratio of voltage output for incidence at angle $\theta$ to that for $\theta=0$, and $d\Omega_0$ is the element of solid angle at angle $\theta$.

The distance factor (DSF) is defined as:

$$DSF = \sqrt{\frac{1}{REE}}$$

A higher distance factor DSF indicates lower pickup of surrounding sound. An omni-directional microphone has a DSF of 1, while a conventional cardioid microphone has a DSF of around 1.7. The highest DSF that is achievable with a first order gradient differential microphone is 2 for the hypercardioid pattern.

Preferably the microphone head has an equivalent noise level of <20 dBSPL (Sound Pressure Level) to obtain at least 60 dB SNR (Signal-to-Noise-Ratio) with a source at 80 dBSPL.

In a preferred embodiment of the invention the microphone head has a unidirectional and/or a microphone characteristic better than a cardioid microphone characteristic. Also a supercardioid (DSF>1,9) or even a hypercardioid (DSF=2) characteristic is possible as long as a sensitive area of the microphone around the main acoustical direction is large or broad enough for normal movements of the head of the speaker.

The directional characteristic allows a larger distance between the speaker and the microphone head. As a result, distance variations of the speaker only have a smaller impact on the pressure level compared to microphones with an omnidirectional characteristic. It is preferred that the delegate unit and/or microphone head is/are operable to be used with a distance between the sound source and the microphone head of around 60 cm or more.

In a preferred technical realization of the invention the microphone head comprises a microphone array with at least two microphone capsules, whereby each of the microphone capsules has a directional microphone characteristic. Preferably, the microphone capsules have a unidirectional, especially a cardioid microphone characteristic and/or a distance factor higher than 1, 7, especially higher than 1,8 or 1,9. It is furthermore preferred, that the at least two microphone capsules are arranged, so that the main acoustical directions of the microphone capsules are parallel to each other. Preferably, the at least two microphone capsules are arranged adjacent to each other, whereby the open distance between two adjacent microphone capsules is preferably smaller than 1 cm. In further embodiments of the invention three, four or more capsules may be used. This realization supports the capability of the microphone head of being used with a larger distance.

In a possible development of the invention the microphone capsules are arranged in a coplanar holder, so that they are arranged in the same plane. It is furthermore preferred, that the coplanar holder is mechanically decoupled from the stem. This development has the advantage, that impact sound from the table or support on which the delegate unit is arranged, is not transferred to the microphone capsules. The mechanically de-coupling may be realized by using acoustically de-coupling means, for example rubber elements between the microphone capsules and the stem. Two or more capsules are used to increase the S(ignal) component in the SNR (Signal-to Noise-Ratio). Additionally, ultra-low noise microphone capsules can been applied to obtain a very low self- or equivalent noise level. The capsules and holder combination defines the final directional characteristic and distance factor.

In order to further improve the sound quality it is preferred, that the microphone capsules, especially the audio signals of the microphone capsules, are connected electrically in parallel. According to this development it is not necessary to use a plurality of audio input lines, whereby each audio input line is used for a single microphone capsule, to the contrary all microphone capsules are in a parallel connection and use the same audio signal input line, which results in a simple and effective setup of the microphone head. Preferably the audio signals are AC-coupled, so that different DC-levels as supply voltage for the microphone capsules do not influence the audio signal.

It is preferred, that the microphone stem body comprises a pre-amplifier for pre-amplifying the audio signals from the microphone head. In other words the pre-amplifier is placed near or as close as possible to the microphone capsules in order to reduce noise from the electronics. As due to the concept of the delegate unit the signal-to-noise-ratio (SNR) and the direct-speech-to-ambient-noise-ratio (DSANR) in the audio signal is probably lower but smoother compared to the conventional delegate units, the pre-amplifier in direct proximity to the microphone head supports to improve the audio quality.

It is furthermore preferred that the delegate unit comprises one or more loudspeakers for rendering a conference signal and an echo cancellation module, whereby the cancellation module is operable to cancel an echo in the audio signal of the microphone head resulting from the conference signal. The conference signal is preferably provided by the conference system, especially by a control module of the conference system. The conference signal may comprise more than one speech signal, especially from different delegate units of the conference system. During operation, the audio signals of the active delegate units, whereby the delegate units are active when the speech signal of the participant of the delegate unit is amplified by the conference system, are mixed together by the control unit in the conference signal. The conference signal is transmitted to the delegate units and especially to the active delegate units. By rendering the conference signal over the loudspeaker(s) of the active delegate unit, the microphone head of the active delegate unit will receive the rendered conference signal of the own loudspeaker(s) of the active delegate unit, so that echo is generated in the active delegate unit. In order to minimize the echo effect, the echo cancellation module suppresses the conference signal in the own audio signal of the microphone head.

The echo cancellation module is integrated in the delegate unit. This has the advantage that the delay between receiving the own speech signal and rendering the conference signal with the own speech signal is not variable but stable and constant. In case the echo processing is performed in the control module, the time for transferring the speech signal to the control module and the time for transferring the conference signal to the delegate unit and thus to the loudspeaker is "uttering", i.e. having a variable delay, In the embodiment as a local module, the echo cancellation module receives the audio signal from the microphone head with a known and stable delay and can observe the input of the loudspeaker also with a known and stable delay. Without the variable delay effects, the echo cancellation is improved.

In a further preferred embodiment the stem is bending resistant and/or rigid. The stem and thus the microphone stem body is bending resistant and/or rigid, so that the position from the microphone head relative to the base body cannot be changed.

It is one finding, that conventional delegate units use a moveable or flexible stem, so that the stem offers the possibility to adjust the direction and a near position relative to the participants mouth for optimal recording of the meeting participant's voice. This way of adjustment of the microphone has the advantage, that the signal-to-noise-ratio (SNR) and the direct-speech-to-ambient-noise-ratio (DSANR) is high because the microphone is positioned as close as possible to the participant and thus to the sound source. The disadvantage of this conventional approach is, that the delegate units are very sensible to amendments of the position of the participants head, which is the sound source: A turning of the head of the speaker will result in a large amplitude variation. When a speaker speaks too close into the microphone, the proximity effect will occur or the microphone capsule will be temporally overloaded. When a speaker speaks too far from the microphone, the SNR will be poor. All such problems will result in coloration and/or distortion of the sound, which will negatively affect the sound quality. As a result the freedom of adjustment of the microphones normally leads due to misalignment or dynamic effect to a decrease of the sound quality in special situations.

To the contrary the invention proposes to use a stationary, fixed or static microphone head, which cannot be adjusted and to compensate the resulting negative effects by using the microphone head with a directional microphone characteristic. As the microphone head due to its fixed position will have a larger distance to the participants head and thus to the sound source compared to the conventional movable stems, the dependency from the exact position of the head is less strict. So it is a difference, if the position of the participants head changes for 10 cm with a distance of for example of 10 cm to the conventional microphone or with a distance of more than 30 cm, preferably more than 40 cm, especially more than 50 cm to the microphone head according to the invention.

The advantage of the invention is thus, that the speaker may dynamically change his position or speech direction, whereby the speaking participant is always in an area, which is central and thus homogenized in view of the main acoustical direction and thus in view of the microphone sensitivity.

In a preferred realization of the invention the base body comprises a display for displaying conference information and/or technical information, whereby in a side view projection of the delegate unit a viewing vector being perpendicular to the display and arranged in the middle of the display and a direction vector being parallel to the main acoustical direction of the microphone head and being placed in the middle of the microphone head meet in a distance between 30 cm and 80 cm away from the display. Normally, the speaker will arrange his head and thus the sound source, so that he can view comfortably the information on the display. So the display is an positioning guide, tool or aid for the speaker's head position. The microphone head is orientated, so that its main acoustical direction is aimed to the area, where the head of the speaker is probably positioned by the speaker in order to optimize the receiving of the speech signal of the participant.

It is furthermore preferred, that the microphone head arranged in the delegate unit has an overall height measured from a or the support area, especially support plane, of the base body of the delegate unit less than 30 cm, preferably less than 20 cm. The reduced height of the microphone head supports the idea of placing the microphone head in a larger distance to the participant's head than usual, in order to have the head of the speaker positioned in a homogenized area of the microphone sensitivity. The overall height is preferably defined as the distance from the support area to the point of maximum height of the microphone head.

A further advantage of the low overall height of the microphone head is, that the usual view of a forest of microphones in a meeting area is prevented, because the microphone heads are optically integrated in the base bodies.

It can be respected that people have quite different body heights, so that—for example during a discussion with international participants—different requirement in view of the overall height may occur. So it is preferred, that the delegate unit comprises a plurality of microphone stem bodies with different heights. It could be possible to provide a first microphone stem body, which results in an overall height of 10 cm and a second microphone stem body with an overall height of 30 cm in order to compensate differences in the body height of 20 cm. It is furthermore possible to provide microphone stem bodies with an overall height of 40 cm or 50 cm or even longer in order to provide a technical solution for very large participants.

As an alternative it is possible that the microphone head has a large acoustical opening angle in the vertical direction, so that no longer stem body will be needed. As an alternative to using microphone stem bodies with different heights or as an additional feature, the different microphone stem bodies may have different pre-amplifiers and/or acoustical opening angles in the vertical direction of the microphone heads to compensate the distance differences.

It is furthermore preferred, that a metal mesh cover at the front and at the rear side of the microphone head is used, to reject radiation of mobile telephones.

In a preferred development of the invention the microphone stem body comprises a mechanical interface for connecting the microphone stem body with the base body. According to the development the mechanical interface is a plug connector, which is used in two functions: on the one hand side the mechanical connection is realized by the plug connector, on the other hand side the audio signals or processed or pre-amplified audio signals are transferred from the microphone head over the plug connector to the base body. Further also additional lines can be used to e.g. control indicating LED's at the top of the microphone head. In order to receive the plug connector it is preferred, that the base body comprises a plug connector.

It is furthermore preferred, that the plug connector is on a rear side of the base body, whereby the stem has a S-Shape so that in a top view projection the microphone head is overlapping with the plug connector. With this mechanical configuration a very compact delegate unit can be realized.

In order to allow this position of the microphone head it is preferred, that the base body comprises a display section with a display and a microphone section with the plug socket, whereby the height of the microphone section is lower than the height of the display section. In this configuration the microphone stem body, especially a middle part of the microphone stem body, is overlapping with the microphone section in a top view projection.

As already explained the delegate unit may comprise a plurality of stems allowing different overall heights of the microphone heads. This is especially important as the requirement of the overall height of the microphone head may be different in case that the participant is standing before the delegate unit or in case that the participant is sitting in front of the delegate unit. Normally the distance between the microphone head and the participant's head is smaller in case the participant is sitting than in case the participant is standing. On the one hand side microphone stem bodies with different overall heights and/or with microphone heads with different opening angles and/or with different pre-amplifiers can be used to compensate this difference. On the other hand side the different distances of the participant's head to the microphone head and other conditions results in a need of a different amplification setup of the delegate unit or of a amplifier of the conference system. In this connection it is preferred, that the delegate unit is operable to identify the type of the microphone stem body used.

This can be realized by transferring a digital ID from the microphone stem body to the base body or by using a mechanical code in the area of the connector plug and the connector socket, whereby the delegate unit and/or the amplifier in the conference system is operable to identify the height, the opening angle and/or the pre-amplifier on basis of the type of the microphone stem body used.

A further subject matter of the invention is a conference system as already described before, whereby the conference system comprises a plurality of the delegate units as described before.

The conference system may comprise a plurality, preferably more than 50, especially more than 100 such delegate units. The conference system is used in meeting rooms or plenary halls, whereby each participant of a discussion may have a own delegate unit. The conference system is operable to receive the speech of the participant, to amplify the speech and to render the speech by loudspeakers or headphones, so that the other participants can listen to the speech of the participant.

BRIEF DESCRIPTION OF THE DRAWINGS

Further advantages, effects and features of the invention will be disclosed by the description of an embodiment of the invention. The figures show.

DETAILED DESCRIPTION

Figure 1:
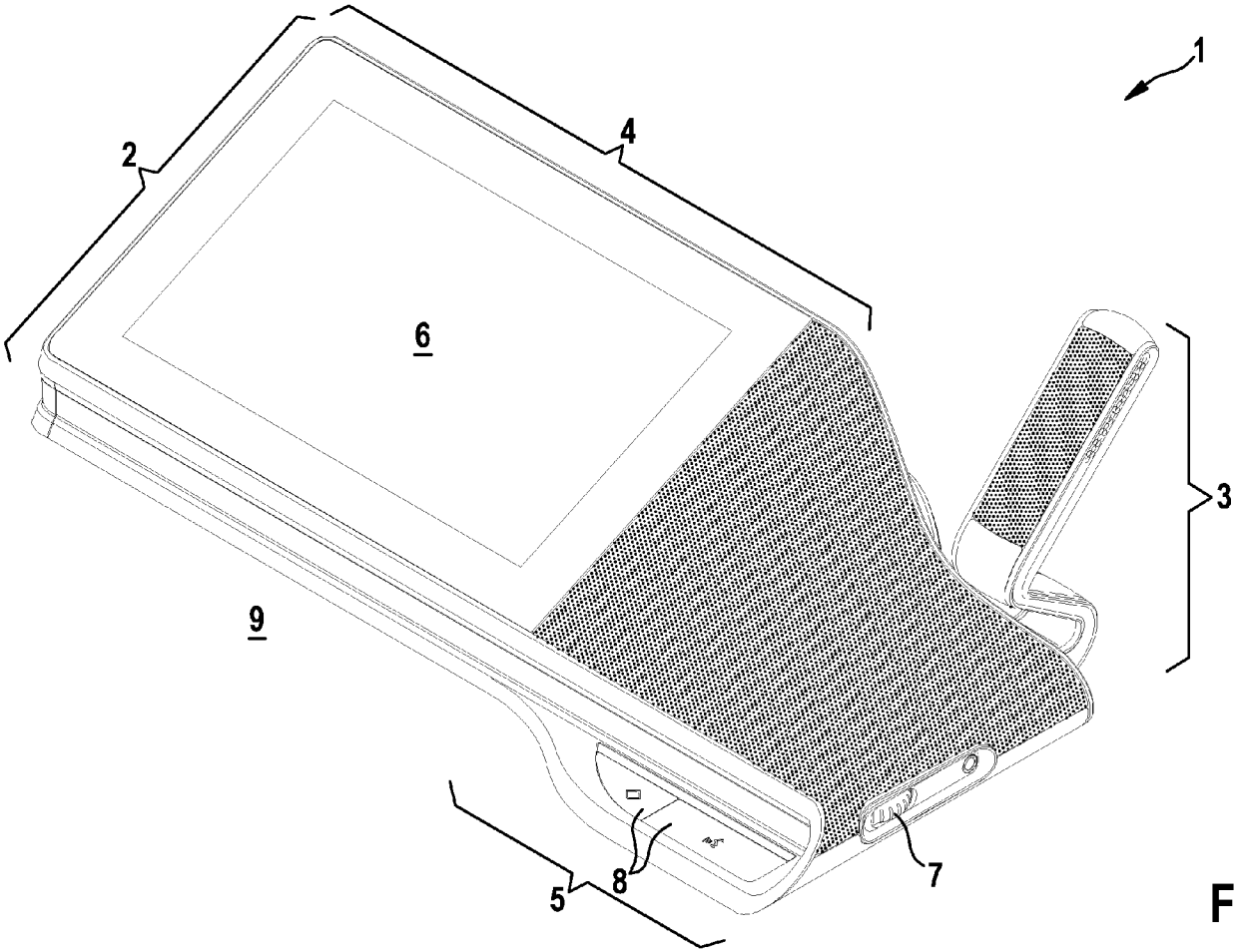
FIG. 1 a three-dimensional view of the delegate unit as an embodiment of the invention.

FIG. 1 shows a three-dimensional view of a delegate unit 1 as an embodiment of the invention. The delegate unit 1 is used in a conference system for supporting discussions in meeting rooms or plenary halls. In some embodiments such a conference system comprises a central unit and a plurality of such delegate units 1 connected to the central module. The function of the delegate unit 1 is to receive a speech signal from a participant as a speaker and transmit the speech signal as an audio signal or as an processed audio signal to the central module. The central module processes the audio signal and transmit it to loudspeakers or headphones in order to render the speech signal as an amplified audio signal or as a conference signal in the surrounding. Often more than 50, 100 or 200 delegate units 1 are connected in a conference system.

The delegate unit 1 comprises a base body 2 and a microphone stem body 3, which is arranged on the base body 2. More specifically the microphone stem body 3 is attached to the base body 2. The base body 2 comprises a housing with a display section 4 and a microphone section 5, whereby a display 6 is integrated in the display section 4 and the microphone stem body 3 is attached to the microphone section 5. Furthermore some controls like a volume control 7 or buttons 8 are integrated in the base body 2, especially in the microphone section 5. The delegate unit 1 is placed on a support area 9, for example a desk or a working place. From the illustration it can be derived, that a height perpendicular to the support area 9 of the display section 4 is higher than the height of the microphone section 5. The delegate unit 1 comprises one or more loudspeakers for rendering the conference signal to the participant in front of the delegate unit 1.

Figure 2:
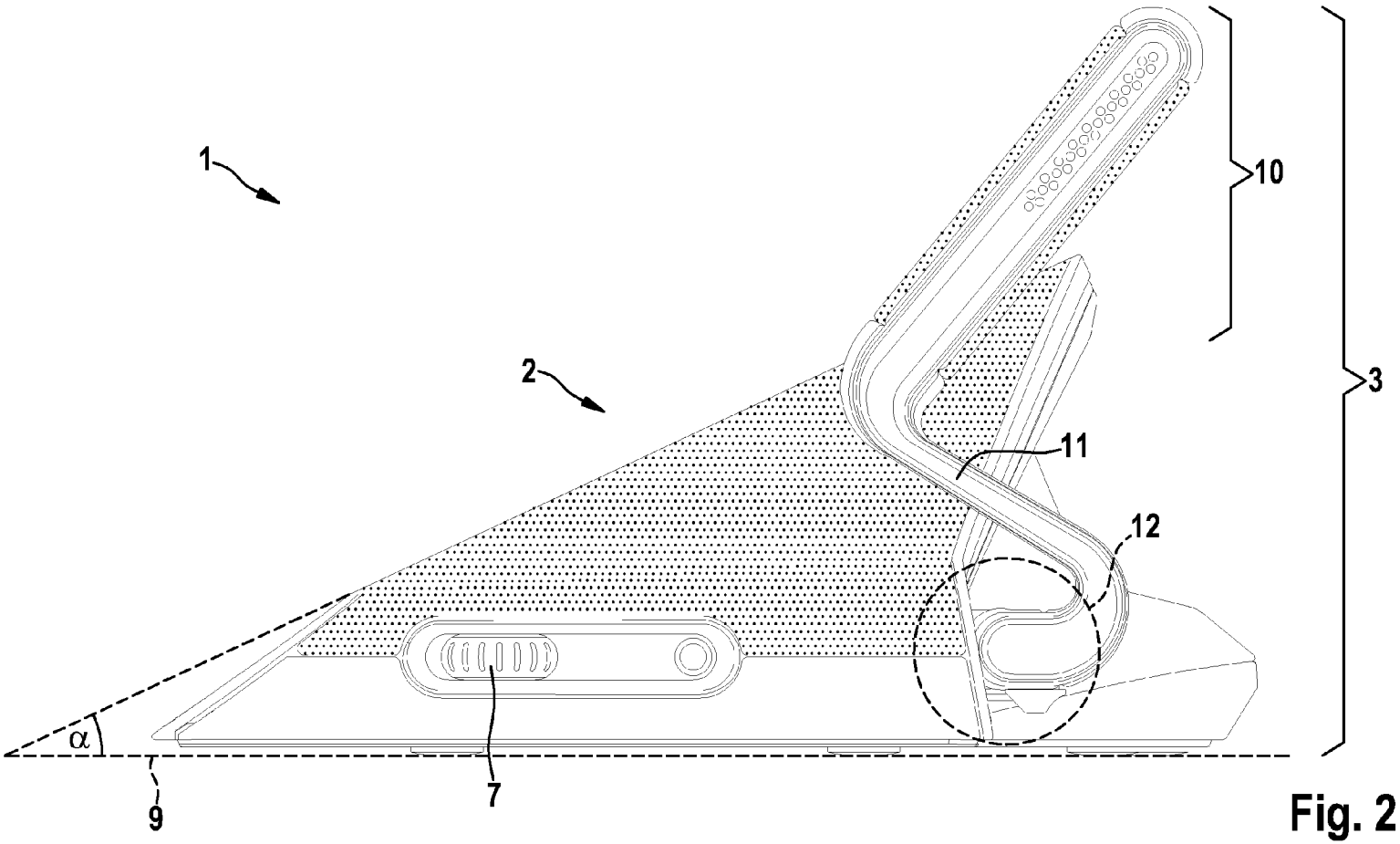
FIG. 2 a side view of the delegate unit of FIG. 1.

FIG. 2 shows a side view of the delegate unit 1 of FIG. 1 in order to describe the geometrical characteristic of the base body 2 and the microphone stem body 3. The front side of the base body 2, especially of the display section 4 is angled with an angle alpha relative to the support area 9. Consequently also the display 6 is angled to the support area 9 with the same angle alpha. The microphone stem body 3 can be divided in a microphone head 10, a stem 11 and a plug connector 12, whereby the microphone head 10 is connected by the stem 11 to the plug connector 12. In the side view as shown in FIG. 2 the microphone stem body 3, especially the stem 11 has an S-shaped form. The S-shaped form has the advantage, that the microphone head 10 can be placed at least partly overlapping to the microphone section 5 of the base body 2 in a top view on the delegate unit 1. In other words, the S-shaped form of the stem 11 allows to place the microphone head 10 a bit closer to the speaker standing in front of the delegate unit 1.

Figure 3:
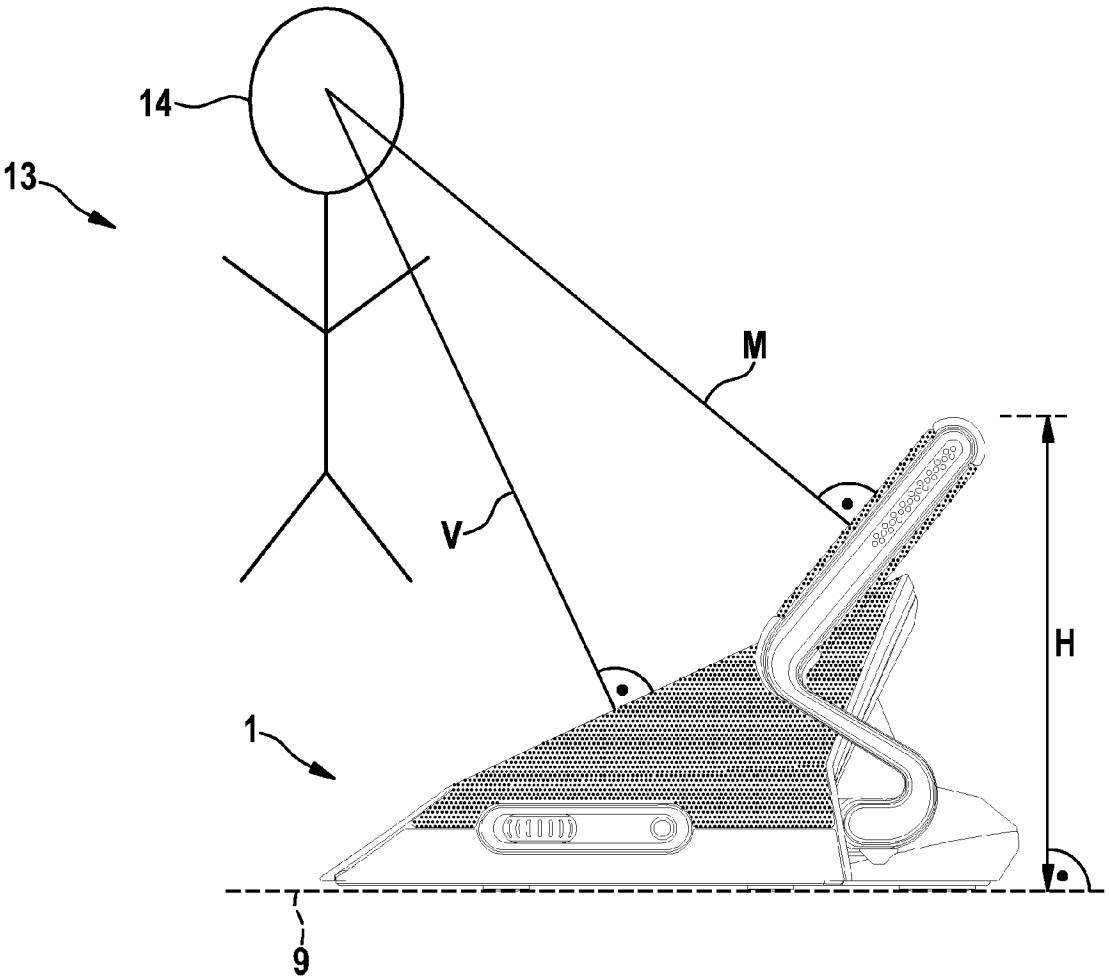
FIG. 3 the delegate unit of FIGS. 1 and 2 in a side view with indications of different dimensions.

FIG. 3 shows the delegate unit 1 in the same way as FIG. 2, whereby some further lines are displayed in the figures. The letter H indicates the overall height of the microphone head 10 in relation to the support plane 9. Furthermore a viewing vector V, which is in the middle of the display 6 and perpendicular to the display 6 is illustrated and a main acoustical direction vector M is shown, which is perpendicular to the middle of the microphone head 10 and illustrates the main axis of sensitivity of the microphone head 10. As illustrated in FIG. 3 the vectors V and M meets in a distance of about 50 cm away from the display 6 in the side view projection. It is assumed that a participant as speaker 13 will arrange his head 14 so that he is in a convenient distant and position in front of the display 6. The microphone head 10 is positioned and orientated, so that he is directed at this assumed position of the head 14 of the participant 13.

Figure 4:
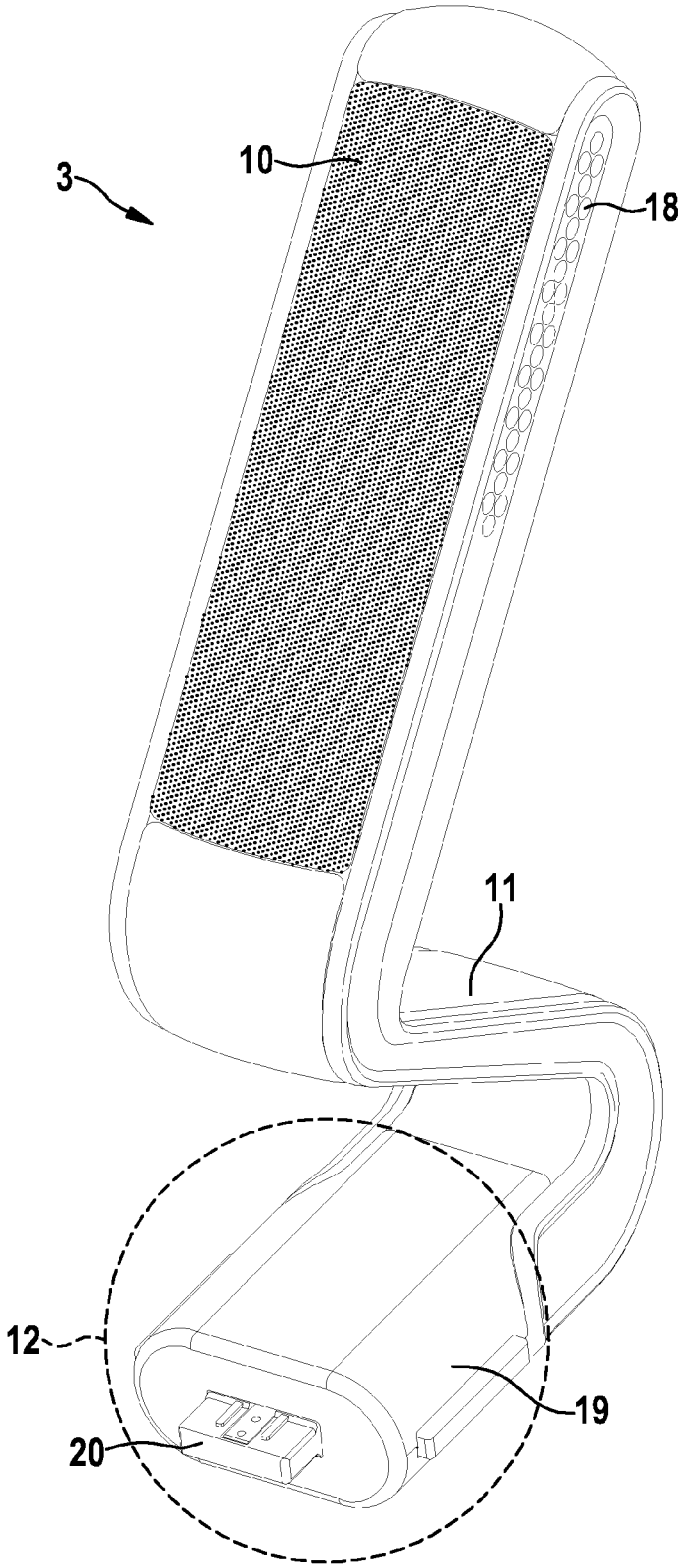
FIG. 4 a three-dimensional view of the microphone stem body of the previous figures.

As it can be seen from the FIG. 4, which illustrates a three-dimensional view of the microphone stem body 3, the microphone stem body 3 and especially the stem 11 is rigid and/or bending resistant. In other words the position of the microphone head 10 is fixed to the base body 2. The microphone head 10 is at one end of the stem 11, the plug connector 12 on the other end side, so that the stem 11 connects the microphone head 10 with the plug connector 12. The plug connector 12 comprises a mechanical section 19 and a electrical section 20. The plug connector 12 is inserted into the base body 2, so that the mechanical and the electrical connection is done by one single step.

The overall height H of the microphone stem body 3 of the embodiment shown is less than 30 cm. In order to adapt the delegate unit 1 to different working positions like standing or sitting participant, a set of exchangeable microphone stem bodies 3 are provided, which can differ in the position, especially the height, the microphone head 10 characteristic, especially the acoustical opening angle, and/or in the pre-amplifier. As the exact acoustical adjustment of the delegate unit 1 also depends from the overall height, the microphone head 10 characteristic, for example the acoustical opening angle, and the pre-amplifier, the delegate unit 1 is adapted to recognize the type of the microphone stem body 3 used, whereby on basis of the type of the microphone stem body 10 the technical parameters of the microphone stem body 10 can be derived. Furthermore the delegate unit 1 is adapted to process the audio signal in dependence of the recognized type of the microphone stem body 3 or to transmit this information to the central module of the conference system.

Returning to FIG. 2 or 3 it can be seen, that the height H of the microphone head 10 is low compared to the conventional delegate units. The advantage of the position of the microphone head 10 is, that the microphone head 10 allows an unobtrusive view over the meeting room or the plenary hall not being disturbed by a forest of microphones. So from a mechanical point of view the microphone head 10 is positioned so that it does not disturb the surrounding. In order to allow this position in view of the audio quality the microphone head 10 is arranged, so that it is aimed at the assumed position of a head 14 of the participant 13.

Furthermore the microphone characteristic is directional, especially cardioid, so that the microphone head 10 is sensitive nearby to the main microphone vector M. For example, the microphone head 10 has a DSF value of higher than 1,7.

Figure 5:
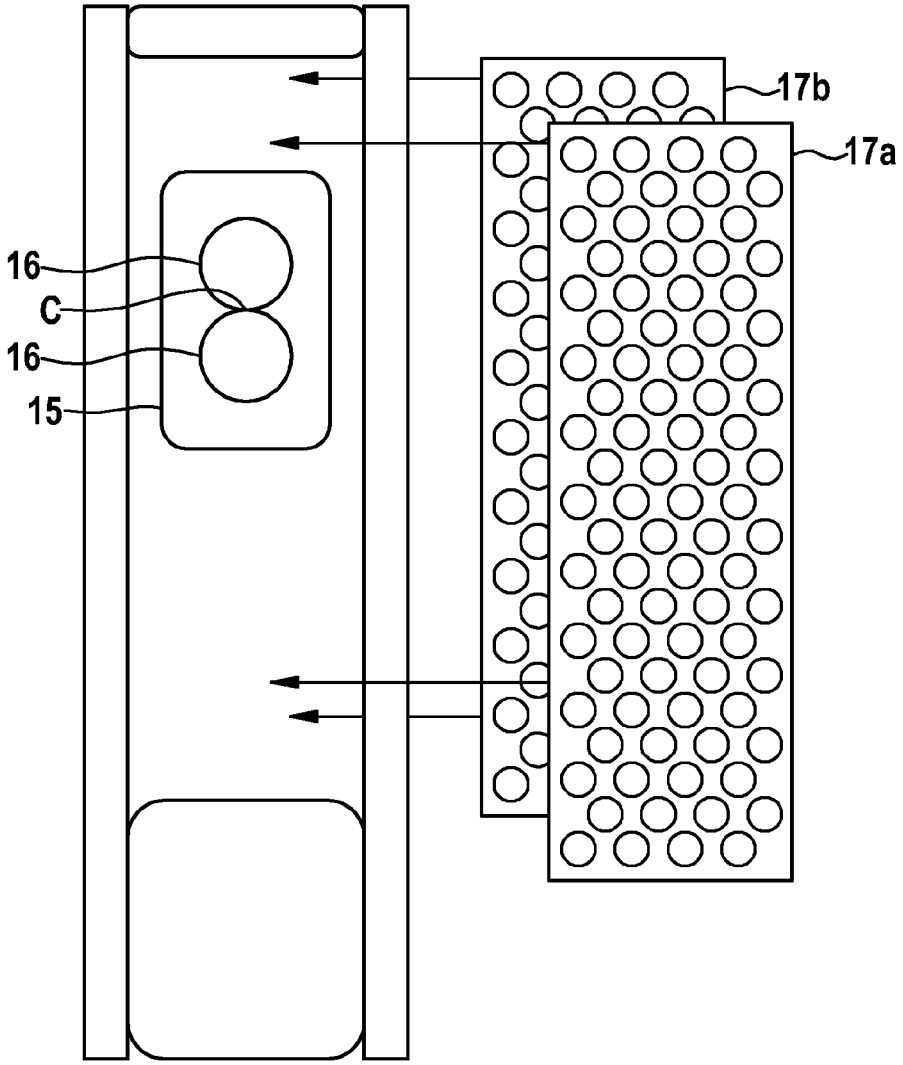
FIG. 5 a schematic illustration of the microphone head of the microphone stem body of FIG. 4.

FIG. 5 shows an illustration of the microphone head 10 of the microphone stem body 3 of FIG. 4. The microphone head 10 comprises a coplanar holder 15 on which two microphone capsules 16 are mounted. The microphone capsules 16 are both directive, whereby the main acoustical directions are parallel to each other and to the main acoustical direction M of the microphone head 10. The coplanar holder 15 is used to control the directivity of the configuration by increasing the mechanical size of the microphone capsules 16. The coplanar holder is furthermore mechanically decoupled from the stem 11. The microphone capsules 16 are positioned close together in order to receive the speech signal in phase. The microphone capsules 16 are connected in parallel, AC-coupled, to avoid drift of working points, which can for example occur when using a JFET or amplifying element for each microphone capsule 16. The microphone head 10 comprises a pre-amplifier in order to pre-amplify the audio signal from the microphone capsules 16, whereby the pre-amplifier is arranged near to the microphone capsules and especially before the stem 11 in order to reduce the effects of noise and interference. The center C of the microphone capsules 16 define the base point for the main acoustical direction M of the microphone head 10.

The microphone head 10 comprises a front and a back cover 17 *a, b* and two side covers 18 (FIG. 4). The covers 17 *a, b*, 18 are inflexible metal covers with holes to guarantee acoustical openness to the microphone capsules 16. The covers 17 *a, b*, 18 form a microphone housing, which is closed in circular direction around the microphone capsules 16 and are adapted to reject stray radiation from mobile telephones.

In order to improve the visual appearance and to enhance the resistance against moisture and dust, a black colored woven metal mesh is mounted in the inflexible front and back cover 17 *a, b*.

During operation, the microphone head has a distance of around 60 cm or more to the participants head. To compensate the distance, a plurality of techniques are incorporated into the delegate unit 1: In the analogue domain, which is in the microphone stem body 3, the microphone head 10 has a directional characteristic and uses at least two microphone capsules 10 to improve the directivity of the microphone head. The microphone capsules are mechanically decoupled from the base body, but electronically AC-coupled in parallel to optimize the resulting audio signal. The resulting audio signal is pre-amplified in the microphone stem body to maximize the SNR (signal-noise-ratio) and/or to obtain a proper input level for the delegate unit. In the digital domain, which is in the base body 2, a basic filtering and a A/D conversion is performed. Furthermore a local echo cancellation module is provided, which cancels echo effects on base of local signals. The echo cancellation module uses the audio signal from the microphone stem body 3 and the conference signal to be rendered by one or more local loudspeaker(s) in the delegate unit 1. These two signals are delay-stable, so that the echo cancellation can be realized in a high quality.

What is claimed is:

1. A delegate unit (1) for a conference system, the delegate unit comprising:

a base body (2), and a microphone stem body (3) comprising a microphone head (10) and a stem (11), wherein the microphone head (10) is arranged on the stem (11) and the microphone stem body (3) is arranged on the base body (2), wherein the microphone head (10) has a directional microphone characteristic, and the microphone head (10) has a distance factor (DSF) preferably equal or higher than 1.7, wherein the microphone stem body (3) comprises a mechanical interface for connecting the microphone stem body (3) with the base body (2), wherein the mechanical interface is a plug connector (12), wherein the base body (2) comprises a plug socket for receiving the plug connector (12), which is arranged on a rear side of the base body (2), and wherein the stem has a S-Shape, so that in a top view projection the microphone head (10) is overlapping with the plug socket.

2. The delegate unit (1) according to claim 1, characterized in that the microphone head (10) has a unidirectional microphone characteristic, being better than a cardioid microphone characteristic.

3. The delegate unit (1) according to claim 1, characterized in that the microphone head (10) comprises a microphone array with at least two microphone capsules (16), wherein each of the microphone capsules (16) has a directional microphone characteristic.

4. The delegate unit (1) according to claim 3, characterized in that the microphone capsules (16) are arranged in a coplanar holder (15), wherein the coplanar holder (15) is mechanically decoupled from the stem (11).

5. The delegate unit (1) according to claim 3, characterized in that the microphone capsules (16) are electrically connected in parallel.

6. The delegate unit (1) according to claim 1, characterized in that the microphone stem body (3) comprises a pre-amplifier for pre-amplifying the audio signals from the microphone head (10).

7. The delegate unit (1) according to claim 1, further comprising a loudspeaker for emitting a conference signal and an echo cancellation module, wherein the cancellation module is operable to cancel an echo in the audio signal of the microphone head (10) resulting from the conference signal.

8. The delegate unit according to claim 1, characterized in that the stem (11) is bending resistant and/or rigid.

9. The delegate unit (1) according to claim 1, characterized in that the base body (2) comprises a display (6), wherein in a side view projection a viewing vector (V), being perpendicular to the display (6), and a direction vector being defined by the main acoustical direction (M) of the microphone head (10) meet in a distance of 30 cm to 80 cm from the display (60).

10. The delegate unit (1) according to claim 1, characterized in that the microphone head (10) has an overall height (H) measured from a support area (9) of the base body less than 30 cm, preferably less than 20 cm.

11. The delegate unit (1) according to claim 1, characterized in that the delegate unit (1) comprises a set of different, interchangeable microphone stem bodies (3) attachable to the base body, wherein the different microphone stem bodies (3) arrange the microphone head (10) in different overall heights (H) and/or whereby the different microphone stem bodies (3) have different pre-amplifiers and/or whereby the different microphone stem bodies (3) have different opening angles of the microphone head (10).

12. A conference system characterized in that the conference system comprises a plurality of the delegate units (1) according to claim 1.

13. The conference system according to claim 12, characterized in that the conference system comprises a control module for mixing the audio signals of at least two delegate unit (1) in a conference signal, wherein the conference signal is transmitted to the plurality of delegate units (1) and emitted by loudspeakers in the delegate units (1).

14. The delegate unit (1) according to claim 1, characterized in that the delegate unit (1) comprises a set of different, interchangeable microphone stem bodies (3) attachable to the base body, wherein the different microphone stem bodies (3) arrange the microphone head (10) in different overall heights (H).

15. The delegate unit (1) according to claim 1, characterized in that the delegate unit (1) comprises a set of different, interchangeable microphone stem bodies (3) attachable to the base body, wherein the different microphone stem bodies (3) have different pre-amplifiers configured at least in part on the specific stem body (3).

16. The delegate unit (1) according to claim 1, characterized in that the delegate unit (1) comprises a set of different, interchangeable microphone stem bodies (3) attachable to the base body, wherein the different microphone stem bodies (3) have different opening angles of the microphone head (10).

17. The delegate unit (1) according to claim 1, wherein the stem has a S-Shape, so that in a top view projection the microphone head (10) is overlapping with a plug socket (12), which connects the microphone stem body (3) with the base body (2).

18. The delegate unit (1) according to claim 4, wherein the coplanar holder (15) is mechanically decoupled from the stem (11) by rubber elements between the microphone capsules and the stem (11).

19. The delegate unit (1) according to claim 3, wherein the microphone capsules (16) are arranged in a coplanar holder (15), wherein the coplanar holder (15) is mechanically decoupled from the stem (11), wherein the microphone capsules (16) are arranged adjacent and parallel to each other and are electrically connected in parallel.

20. The delegate unit (1) according to claim 1, wherein the microphone head (10) has a distance factor (DSF) higher than 1.8.

21. A conference system characterized in that the conference system comprises a plurality of the delegate units (1), wherein each delegate unit includes a base body (2), and a microphone stem body (3) comprising a microphone head (10) and a stem (11), wherein the microphone head (10) is arranged on the stem (11) and the microphone stem body (3) is arranged on the base body (2), and wherein the microphone head (10) has a directional microphone characteristic, and the microphone head (10) has a distance factor (DSF) preferably equal or higher than 1.7; and a control module for mixing the audio signals of at least two delegate unit (1) in a conference signal, wherein the conference signal is transmitted to the plurality of delegate units (1) and emitted by loudspeakers in the delegate units (1).

* * * * *